United States Patent [19]

Chen et al.

[11] Patent Number: 4,660,241

[45] Date of Patent: Apr. 28, 1987

[54] MULTIPURPOSE PLIERS

[76] Inventors: Ching-Win Chen; Ching-Jen Chen, both of No. 11, Lane 60, Mei-Ning St., Tai-Shan Hsiang, Taipei Hsien, Taiwan

[21] Appl. No.: 766,114

[22] Filed: Oct. 10, 1985

[51] Int. Cl.[4] ..... B25F 1/00

[52] U.S. Cl. ..... 7/107; 7/132; 7/139; 7/127; 29/566.4

[58] Field of Search ..... 7/107, 132, 138, 139, 7/158, 125, 133, 134, 127; 29/564.4, 566.4

[56] References Cited

U.S. PATENT DOCUMENTS

| | | | |
|---|---|---|---|
| 2,696,747 | 12/1954 | Bergan | 81/313 |
| 2,784,621 | 3/1957 | Klingler | 7/133 |
| 3,157,075 | 11/1964 | Filia | 81/313 |
| 4,048,877 | 9/1977 | Undin | 81/313 |
| 4,170,154 | 10/1979 | Izraeli | 81/313 |

FOREIGN PATENT DOCUMENTS

| | | | |
|---|---|---|---|
| 541465 | 5/1922 | France | 7/139 |
| 1342312 | 9/1963 | France | 81/313 |

*Primary Examiner*—Roscoe V. Parker
*Attorney, Agent, or Firm*—Lane and Aitken

[57] ABSTRACT

A multipurpose pliers for wire stripping, cutting and terminal crimping comprising a handle assembly, a stripping device, a cutting and crimping device and a wrench device, which, by means of a brake block controls opening and closing of a moveable handle, action of a linkage to drive the stripping device and the cutting and crimping device to open and close so wire stripping, cutting and terminal crimping, and by means of the wrench device to lock terminals of wires with nuts.

5 Claims, 7 Drawing Figures

MULTIPURPOSE PLIERS

BACKGROUND OF THE INVENTION

Conventionally, each hand tool used for wiring jobs serves a single purpose, and an electrician usually has to maintain a number of hand tools for various purposes, such as for stripping, cutting, terminal connecting, and so on. This is inconvenient. In view of this problem, the inventor has created a multipurpose pliers to do a number of wiring jobs.

SUMMARY OF THE INVENTION

The present invention provides a multipurpose pliers composed of a handle assembly, a stripping device, a cutting and crimping device and a wrench device. The present invention uses the handle assembly, which has a brake block, to control the opening and closing of a moveable handle to open and close the stripping device and the wire cutter and crimping device for wire stripping, cutting and terminal crimping. Furthermore, the present invention has a wrench device for securing a wire on a screw terminal using a nut. The present invention provides a multipurpose pliers for an electrician.

BRIEF DESCRIPTION OF THE DRAWINGS

The structure and function of the present invention are described below with reference to the attached drawings, wherein.

DESCRIPTION OF THE PREFERRED EMBODIMENT

The present invention provides a multipurpose pliers for wire stripping, wire cutting and terminal crimping.

Figure 1:
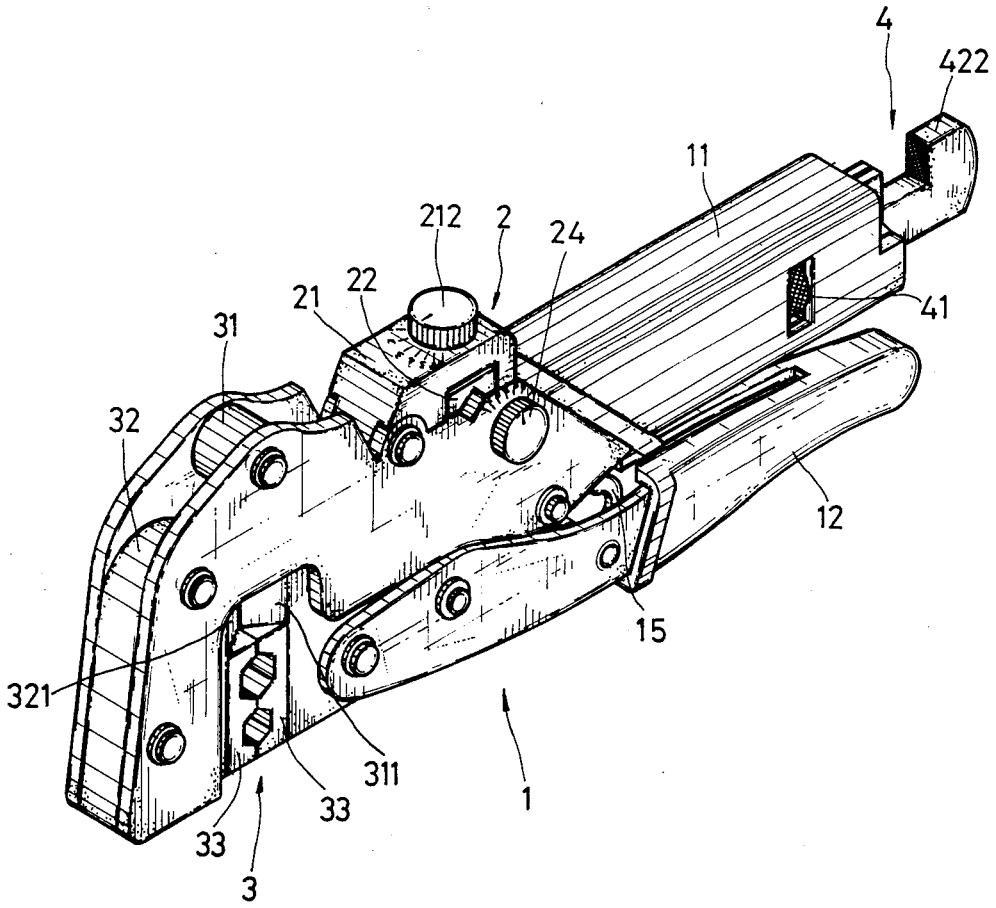
FIG. 1 is a perspective view for a preferred embodiment of the present invention.
Figure 2:
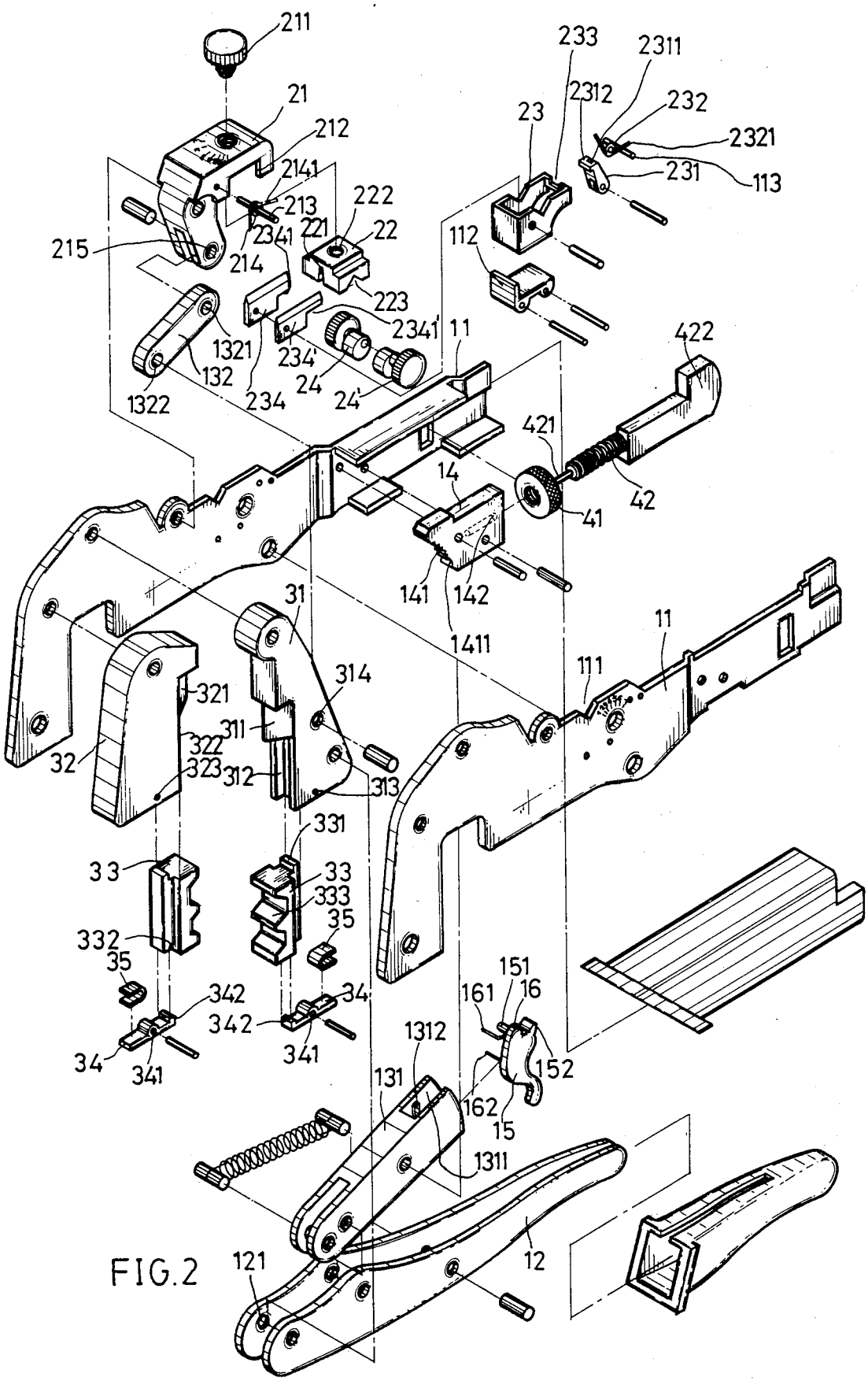
FIG. 2 is an exploded view of the preferred embodiment of the present invention as shown in FIG. 1.
Figure 3:
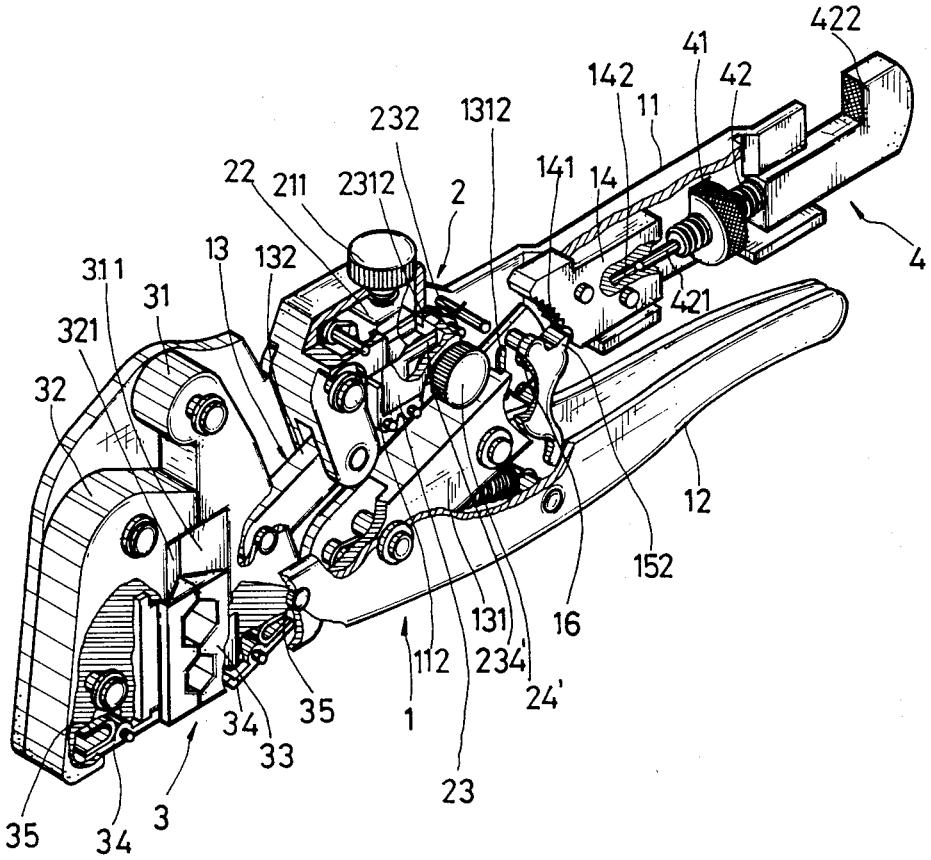
FIG. 3 is a cutaway perspective view of the present invention as shown in FIG. 1.

As shown in FIGS. 1 through 3, the present invention is composed of a handle assembly 1, a stripping device 2, a cutting and crimping device 3 and a wrench device 4. The handle assembly 1 is composed of a fixed handle 11, a moveable handle 12, a linkage 13, a rachet 14, a brake block 15 and an elastic element 16. The said linkage 13 is formed by a main link 131 and a secondary link 132. The main link 131 has a pin hole at each end. Each pin hole corresponds to a pin hole in the fixed handle 11 or the moveable handle 12. Both of the handles are connected to two ends of the main link 131 by means of pins. The moveable handle 12 has another pin hole 121 for connecting it to the upper jaw 31 of the cutting and crimping device 3. The main link 131 has a slot 1311 with an arcuate surface 1312. The slot 1131 holds brake block 15 so that two extensions 161 and 162 of an elastic element 16 on the brake block 15 are held within the arcuate slot 1312. The brake block 15 has three pins 151 for positioning the elastic element 16 and its extensions 161 and 162. The brake block 15 has also a stud 152 corresponding to the teeth 141 of the rachet 14.

The link 132 has a pin hole 1322 or 1321 at each end. The pin holes 1322 and 1321 correspond to the pin holes 314 and 213 of the upper jaw 31 and a stripping vise 21 which are connected to both ends of the link 132 by means of pins. The said stripping device is mainly composed of a stripping vise 21, an adjusting block 22, a knife seat 23 and two adjusting cams 24 and 24'. The stripping vise 21 has an adjusting scale and an adjusting button 211 on its top and a slot 212 at its bottom. The slot 212 is for placing the adjusting block 22 which has a groove 221, a recess 222 and an upper aperture 223. A fixing pin 213 is installed at a side of the slot 212 on the stripping vise 21. A spring 214 is fixed to the fixing pin 213. An extension 2141 of the spring 214 is kept within the groove 221 at the adjusting block 22 to position the adjusting block 22. A knife seat 23 is fixed just below the adjusting block 22. The knife seat 23 is placed on a fixing block 112 of the fixed handle 11. A moveable block 231 is connected to the fixed handle 11 by means of a pin. The moveable block 231 has a slot 2311 within which an elastic element 232 is held. Two extensions 2321 of the elastic element 232 push against the fixing pins 113 in the fixed handle 11 and the slot 2311 in the moveable block 231 respectively in order to position an end 2312 of the moveable block 231 within a recess 233 in the knife seat 23 for fixing the knife seat 23. In the knife seat 23 two knives 234 and 234' of different heights are installed. Just below each of the respective openings 2341 and 2341' in the knives 234 and 234' an adjusting cam 24 and 24' is installed. These two adjusting cams 24 and 24' are installed on respective sides of the fixed handle 11. The fixed handle 11 has a scale and a lower aperture 111 which corresponds to the upper aperture 223. By moving the end 2312 of the moveable block 231 and compressing the elastic element 232, the end 2312 of the moveable block can be disengaged from the recess 233 in the knife seat 23 to facilitate removal of replacement of knife seat 23.

An upper jaw 31 and a lower jaw 32 are symmetrically fixed to the fixed handle 11 by means of a pin. The upper jaw 31 and the lower jaw 32 have symmetrical blades 311 and 321 for wire cutting. Beneath the blades 311 and 312 there are sliding slots 312 and 322 permitting the sliding insertion of a corresponding rail 331 on each of the respective crimping blocks 33. The rail 331 has an opening 332 at its bottom. There are teeth 333 of different size on the crimping block 33. The upper jaw 31 and the lower jaw 32 have pin holes 313 and 323. The shaft hole 341 of the stop plate 34 is fixed to these pin holes 313 and 323 by means of pins. When each of the respective crimping blocks 33 is fixed to the upper jaw 31 and the lower jaw 32, the vertical extension 342 of the stop plate 34 is inserted into and held within the opening 332 in the crimping block 33, and the action of the elastic element 35 holds the stop plate 34 within the opening 332 in order to fix the crimping block 33, and consequently, the stop plate 34 compresses the elastic element 35, the stop plate 34 can pivot around its shaft hole 341, the extension 342 of the stop plate 34 is separated from the crimping block 33 for removing the crimping block 33.

The said wrench assembly 4 is composed of an adjusting button 41 and a screw rod 42. The screw rod 42 has an extension 421 at its front end which is inserted within the shaft hole 142 of the gear 14 in order to prevent the screw rod 42 from rocking. The end of the screw rod 42 has a movable vise block 422.

In the handle assembly 1, pressing the moveable handle 12 causes the linkage 13 to drive the cutting and crimping device 3 as well as the stripping device 2. By action of the stud 152 on the brake block 15, and the automatic direction change provided by the brake block 15, the cutting and crimping device 3 and the stripping device are controlled so as to serve a plurality of purposes: wire cutting, terminal crimping, and wire stripping.

The knife seat 23 in the stripping assembly 2 is replaceable. For replacement, it is necessary to move the moveable block 231 only. By compressing the elastic element 232 by the moveable block 231, the end 2312 of the moveable block 231 is disengaged from the opening 233 in the knife seat 23 to facilitate removal or installation of the knife seat 23. In the stripping assembly 2, the adjusting button 211 adjusts the vertical displacement of the adjusting block 22 to set the size of the opening between the upper and lower apertures 223 and 111 to fit the diameter of the wire. Upward and downward movements of the respective knives 234 and 234' can be adjusted by the two adjusting cams 24 and 24' to set depth of stripping.

The cutting and crimping device 3 has a replaceable crimping block 33. It is thus adjustable to fit wire of different sizes to ease terminal crimping. To replace the crimping block 33, it is necessary to press the stop plate 34 in order to compress the elastic element 35 so that the stop plate 34 moves around its shaft hole and its extension 342 is disengaged from the crimping block 33 (see FIG. 1). Such a replacement requires no special tool and the replacement can be done very easily when the occasion arises.

In the wrench device 4, the adjusting knob is rotated to adjust forward and backward displacement of the screw rod 42 in order to set the gap between the fixed handle and the vise block on the screw rod for use as a wrench.

Figure 4:
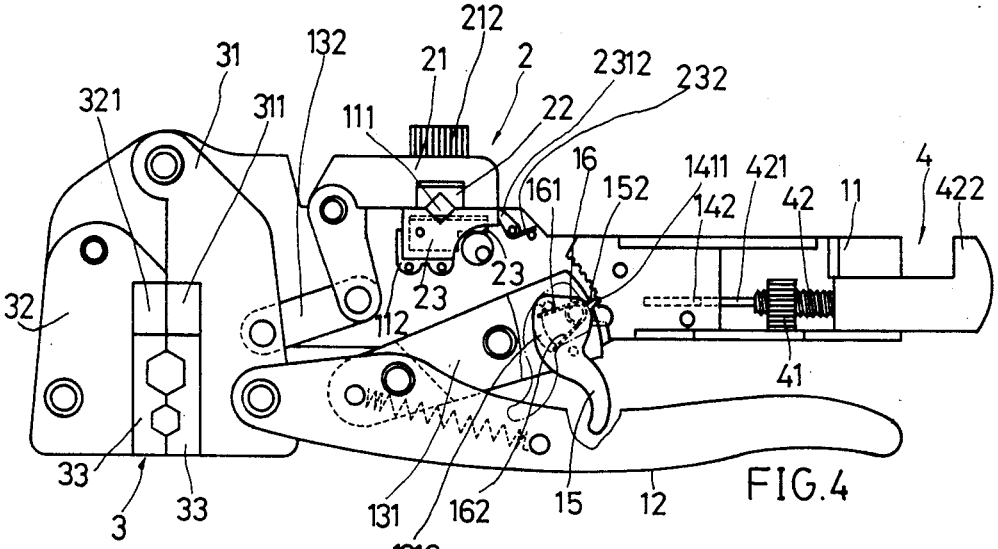
FIG. 4 is a schematic view of the preferred embodiment of the present invention.
Figure 5:
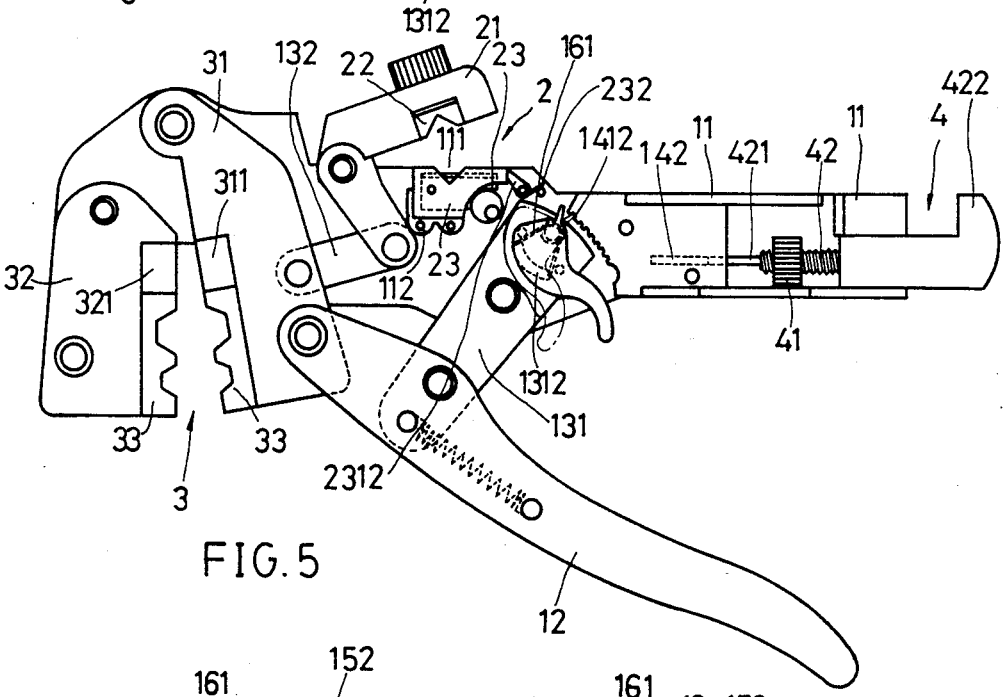
FIG. 5 is a schematic view of the preferred embodiment of the present invention.
Figure 6:
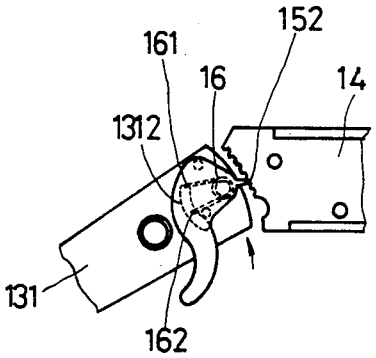
FIG. 6 is a partial schematic view illustrating a continuation of the action indicated in FIG. 4.
Figure 7:
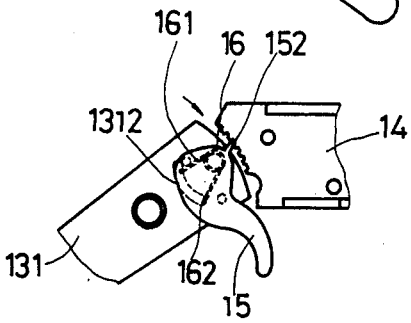
FIG. 7 is a partial schematic view illustrating a continuation of the action indicated in FIG. 5.

FIG. 4 is a schematic view of the present invention in a first position, and FIG. 5 is a schematic view of the present invention in a second position. FIG. 6 illustrates a continuation of the action shown in FIG. 4 and FIG. 7 illustrates a continuation of the action shown in FIG. 5. FIG. 4 shows the hand tool prior to use. At that stage, the stud 152 on the brake block 15 is just on the first tooth 1411 of the rachet 14, and the two extensions 161 and 162 of the elastic element 16 are fully open. If the moveable handle 12 is released, the brake block 15 is forced upward by the main link 131 and thus the stud 152 moves upwards from the first tooth 1411 of the rachet 14, and simultaneously, an extension 151 of the elastic element 16 is compressed by the arcuate slot 1312, as shown in FIG. 6, until the stud 152 on the brake block 15 moves beyond the last tooth 1412 of the rachet teeth 141, as show in FIG. 5. Then, when no longer compressed by the arcuate slot 1312, the extension 161 of the elastic element relaxes, permitting the brake block 15 to change its direction, and the stripping device 2 and the cutting and crimping device 3 are automatically fully opened by action of the linkage 13 and ready for use, as shown in FIG. 5. Then, by pressing on the moveable handle 12, the stud 152 moves downwards along the teeth 141 of the rachet 14, as shown in FIG. 7, for wire stripping, cutting or terminal crimping. As soon as these devices move to the positions shown in FIG. 1, the tool has closed to its fullest extent.

We claim:

1. A multipurpose pliers for wire stripping, wire cutting and terminal crimping comprising:

a handle assembly including a fixed handle, a moveable handle, a linkage connected between said handles, a brake block mounted on said linkage and a rachet mounted on said fixed handle coacting with said brake block so that by pressing the moveable handle the brake block permits the linkage to pivot the moveable handle away from said fixed handle;

a stripping device on said fixed handle, including a stripping vise, an adjusting block and adjusting cams, which are connected so that said handle assembly opens and closes the stripping vise by pivoting of said moveable handle, said vise holding two knives of different heights in a position such that they strip the wire;

a cutting and crimping device composed of an upper jaw, a lower jaw, a crimping block mounted between said jaws, said crimping block having teeth, said jaws being connected to said handle assembly so that movement of the moveable and fixed handles of the handle assembly drives the upper jaw and the lower jaw to make a corresponding movement such that the jaws cut wire and the teeth of the crimping block crimp terminals onto wire; and a wrench device mounted on said fixed handle including an adjusting knob and a screw rod shaped and connected to a vise block so that a gap between the said fixed handle and the vise block is set by rotating the screw rod using the adjusting knob.

2. A multipurpose pliers for wire stripping, wire cutting and terminal crimping as claimed in claim 1, wherein the brake block in the handle assembly has an elastic element positioned to pivot about a first pin therein, said elastic element having two extensions positioned in an arcuate slot, said brake block further having a stud positioned to engage the teeth of the rachet so that when the stud moves upwards or downwards on the ratchet, an extension of the elastic element is compressed by second and third pins on said brake block, and when the stud passes over the first or last tooth of the rachet, the elastic element relaxes so that said brake block changes its direction automatically thereby permitting movement of the fixed and moveable handles in the opposite direction.

3. A multipurpose pliers for wire stripping, wire cutting and terminal crimping as claimed in claim 1 wherein said cutting and crimping device includes a stop plate pivotally mounted on said jaws and an elastic element which is compressed when said said stop plate pivots, and wherein said jaws have slots in which the crimping block of the cutting and crimping device is slidably mounted to be removed for replacement by pressing the stop plate so that the elastic element is compressed and the stop plate pivots until a vertical extension of the stop plate is separated from the teeth of the crimping block which then can be disengaged from the slots in the upper jaw and lower jaws.

4. A multipurpose pliers or wire stripping, wire cutting and terminal crimping as claimed in claim 1 wherein, said knives of said stripping vise have respective adjusting cams in contact therewith, said cams being shaped and positioned to adjust the upward and downward displacement of the knives, thereby setting the depth of stripping, and further comprising an adjusting knob shaped and positioned to contact the adjusting block so that it varies a gap between upper and lower apertures of the stripping vise to fit the diameter of wire to be stripped.

5. A multipurpose pliers for wire stripping, wire cutting and terminal crimping as claimed in claim 1 wherein said stripping device has a knife seat for holding said knives, a moveable block mounted on said fixed handle to engage said knife seat, an elastic element compressable by said moveable block, said knife seat being shaped and positioned such that it is removed for replacement by moving said moveable block to compress said elastic element in order to disengage the moveable block from the knife set.

* * * * *